US010252227B2

(12) United States Patent
Jung et al.

(10) Patent No.: US 10,252,227 B2
(45) Date of Patent: Apr. 9, 2019

(54) SYSTEM AND METHOD FOR STARTING UP STIRRING MACHINES IN A SEDIMENT

(71) Applicant: EKATO RÜHR-UND MISCHTECHNIK GMBH, Schopfheim (DE)

(72) Inventors: Jochen Jung, Lörrach (DE); Wolfgang Keller, Sierentz (FR)

(73) Assignee: EKATO Ruehr- und Mischtecnik GmbH, Schopfheim (DE)

( * ) Notice: Subject to any disclaimer, the term of this patent is extended or adjusted under 35 U.S.C. 154(b) by 1108 days.

(21) Appl. No.: 14/387,113

(22) PCT Filed: Mar. 20, 2013

(86) PCT No.: PCT/EP2013/000846

§ 371 (c)(1),
(2) Date: Sep. 22, 2014

(87) PCT Pub. No.: WO2013/139477

PCT Pub. Date: Sep. 26, 2013

(65) Prior Publication Data

US 2015/0085598 A1 Mar. 26, 2015

(30) Foreign Application Priority Data

Mar. 23, 2012 (DE) ..... 10 2012 006 001
Mar. 20, 2013 (DE) ..... 10 2013 004 827

(51) Int. Cl.
*B01F 3/00* (2006.01)
*B01F 3/12* (2006.01)
(Continued)

(52) U.S. Cl.
CPC ..... *B01F 3/1221* (2013.01); *B01F 7/00275* (2013.01); *B01F 7/00291* (2013.01);
(Continued)

(58) Field of Classification Search
CPC ..... B01F 3/1221; B01F 2003/1257; B01F 2003/1264; B01F 7/00008; B01F 7/00208;
(Continued)

(56) References Cited

U.S. PATENT DOCUMENTS 2,996,287 A * 8/1961 Audran ..... B01F 7/1625 261/121.1
3,343,919 A * 9/1967 Miller ..... B01F 1/0022 422/106
(Continued)

FOREIGN PATENT DOCUMENTS

DE 3 442 294 5/1986
EP 0 624 406 11/1994
(Continued)

OTHER PUBLICATIONS

International Search Report issued by the European Patent Office in International Application PCT/EP2013/000846.
(Continued)

*Primary Examiner* — Katherine Zalasky
(74) *Attorney, Agent, or Firm* — Posz Law Group, PLC

(57) ABSTRACT

A system and an associated method for starting up stirring machines in a sediment in a controlled manner are provided, which system has the following: a container for receiving materials to be processed; a stirring device with stirring blades for stirring the materials to be processed in the container; a purging device; and a device for operating stirring machines. The purging device is arranged in such a way and set up so as to feed a medium for purging to a deposited sediment. Furthermore, a controller is provided which initiates controlled re-starting of stirring machines after purging.

23 Claims, 5 Drawing Sheets

(51) Int. Cl.

| | |
|---|---|
| ***B01F 7/00*** | (2006.01) |
| ***B01F 7/18*** | (2006.01) |
| ***B01F 13/02*** | (2006.01) |
| ***B01F 15/00*** | (2006.01) |
| ***B01F 13/04*** | (2006.01) |
| ***B08B 9/093*** | (2006.01) |

(52) U.S. Cl.
CPC ..... *B01F 7/00633* (2013.01); *B01F 7/18* (2013.01); *B01F 13/0211* (2013.01); *B01F 13/0216* (2013.01); *B01F 13/0255* (2013.01); *B01F 13/045* (2013.01); *B01F 15/00025* (2013.01); *B01F 15/00032* (2013.01); *B01F 15/00155* (2013.01); *B01F 15/00162* (2013.01); *B01F 15/00538* (2013.01); *B01F 15/00922* (2013.01); *B08B 9/0933* (2013.01); *B01F 2003/0028* (2013.01); *B01F 2003/1285* (2013.01)

(58) Field of Classification Search
CPC ..... B01F 7/00233; B01F 7/00275; B01F 7/00291; B01F 7/003; B01F 7/0025; B01F 7/00625; B01F 7/00633; B01F 7/16; B01F 7/18; B01F 13/02; B01F 13/0211; B01F 13/0216; B01F 13/0255; B01F 13/0266; B01F 13/045; B01F 13/047; B01F 15/00123; B01F 15/00253; B01F 15/00233; B01F 15/00207; B01F 15/00129; B01F 15/00155; B01F 15/00162; B01F 15/00538; B01F 15/00922; B01F 15/0203; B01F 15/04; B01F 15/0408
See application file for complete search history.

(56) References Cited

U.S. PATENT DOCUMENTS

| | | | | | |
|---|---|---|---|---|---|
| 3,826,476 | A * | 7/1974 | Ahrenberg | B22C 5/08 | 366/17 |
| 4,100,610 | A * | 7/1978 | Johnston | A01C 3/026 | 137/505.13 |
| 4,249,828 | A * | 2/1981 | Condolios | B01F 15/00201 | 366/102 |
| 4,519,959 | A | 5/1985 | Takeuchi | | |
| 4,606,648 | A * | 8/1986 | Coyle | B01F 7/1665 | 366/297 |
| 4,688,945 | A * | 8/1987 | Brazelton | B01F 5/0057 | 366/156.1 |
| 4,882,098 | A * | 11/1989 | Weetman | B01F 3/04531 | 209/169 |
| 5,620,250 | A * | 4/1997 | Chilcoat | B01F 5/0218 | 239/233 |
| 5,685,640 | A * | 11/1997 | Goedicke | B01F 13/0255 | 222/195 |
| 5,925,293 | A * | 7/1999 | Howk | B01F 3/04248 | 261/123 |
| 6,311,847 | B1 * | 11/2001 | Soldwish-Zoole | B01F 13/1002 | 209/156 |
| 6,439,756 | B1 * | 8/2002 | Forschner | B01F 3/04588 | 261/87 |
| 7,331,704 | B2 | 2/2008 | Howk | | |
| 2009/0046535 | A1 * | 2/2009 | Carlson | B01F 11/0258 | 366/118 |
| 2010/0044323 | A1 * | 2/2010 | Asplund | B01F 3/188 | 210/773 |
| 2010/0118643 | A1 | 5/2010 | Keller | | |
| 2011/0100932 | A1 * | 5/2011 | Lonnqvist | B01D 15/20 | 210/803 |
| 2015/0085598 | A1 | 3/2015 | Jung et al. | | |

FOREIGN PATENT DOCUMENTS

| | | | |
|---|---|---|---|
| EP | 0624406 | A1 | 11/1994 |
| EP | 1 205 238 | | 5/2002 |
| EP | 2827975 | B1 | 5/2016 |
| RU | 2 410 419 | C1 | 1/2011 |
| SU | 30597 | A1 | 5/1933 |
| WO | 98/09919 | A1 | 3/1998 |
| WO | WO98/09919 | | 3/1998 |
| WO | 2008/082339 | A1 | 7/2008 |
| WO | WO2008/082339 | | 7/2008 |
| WO | WO2009/157853 | | 12/2009 |
| WO | 2013/139477 | A2 | 9/2013 |

OTHER PUBLICATIONS

Office Action dated Sep. 8, 2017 corresponding to Canadian patent application No. 2,866,951.
Office Action dated Feb. 21, 2017 issued in corresponding AU patent application No. 2013234754 (and e-mail from foreign associate with comments on office action).
Office Action dated Dec. 13, 2016 issued in corresponding CA application No. 2,866,951.
Email dated Jan. 31, 2017 explaining the content of CA Office Action.
Office Action and Search Report dated Jul. 15, 2016 issued in corresponding RU patent application No. 2014 142 574 (and English translation).

* cited by examiner

SYSTEM AND METHOD FOR STARTING UP STIRRING MACHINES IN A SEDIMENT

CROSS-REFERENCES TO RELATED APPLICATIONS

This application is the U.S. National Stage of International Application No. PCT/EP2013/000846, filed Mar. 20, 2013, which designated the United States and has been published as International Publication No. WO 2013/139477 and which claims the priority of German Patent Application, Serial No. 10 2012 006 001.7, filed Mar. 23, 2012, pursuant to 35 U.S.C. 119(a)-(d).

BACKGROUND OF THE INVENTION

The present invention relates to a system and a method for starting up stirring machines in a sediment in a controlled manner.

If a stirring means sits in a solid matter sediment, "starting up in a sediment" is what is spoken of. This case may occur if a stirring machine has stopped, either due to operative causes or due to a disturbance, e.g. a power breakdown, contrary to requirements, while processing suspensions. The solid matter sinks downward in the container and forms a sediment. Depending on solid matter content of the suspension and on a position of stirring elements, the sediment covers the stirring element or elements. In dependence of a period length of a standstill, the sediment subsequently densifies. Starting up following standstill thus becomes more difficult up to impossible.

For starting up stirring machines in a sediment the following proposals have been made so far:

It has been tried to position stirring elements above a sediment or to reduce the sediment level, such that the stirring elements are not stuck in the sediment. However, for achieving satisfactory stirring, stirring elements generally need to be positioned in the bottom third of a container. Deviating too far from this positioning is usually not admissible as this does not make any sense with the actual task of stirring, namely "suspending". A reduction of the sediment level would require of an operator of an installation to process less material or to process a suspension having less solid matter content, which would not provide any commercial benefit.

It may also be envisaged that, for supporting a startup of stirring machines in a sediment, purging by air is carried out, which could be done, for example, by way of gassing lances if present. In many cases, pressurized air that is at hand could be used anyway. In the case of an application with a gassing device below the stirring element, this device can also be used. There is, however, the disadvantage herein that air is compressible and will bubble upwards in an unspecific fashion. Furthermore, the openings of the gassing system are susceptible to clogging. Purging by air moreover fails if lances are arranged above the stirring element.

There is also the simple option to empty the container, such that starting up stirring machines in a sediment is not required at all. This method, even if fail-safe, has the disadvantages that it takes much time, and that liquid having a high degree of acidity or alkalinity, as well as a sediment, have to be transferred away and stored in an interim place.

Another possibility is given in making the stirring element rotate backwards, which reverse operation is easily achieved providing a frequency inverter or a pole reversal. There is, however, the disadvantage that a reduction of the starting-up torque depends on the type of stirring element and, in particular, on the blade geometry. Blades could break due to their shape and mechanics not necessarily being designed for the reverse direction.

Furthermore, emergency power units could be provided for stirring machines. One or several stirring machines can be operated simultaneously or alternatingly, such that solid matters are not deposited. However, for many major stirring machines providing emergency power units is connected with huge investment costs. Intermittingly operating a plurality of stirring machines yields the advantage that the emergency power supply may be designed smaller, but has the disadvantage that re-switching of a stirring machine only works if the depositing periods have a sufficient length. For example, even in big containers having a filling level of 10 to 20 m and with a high particle sinking speed of 1 to 10 cm per sec, the sediment is formed in a few minutes.

U.S. Pat. No. 7,331,704 B2 describes a draft tube arrangement with a stirring element. The stirring element is arranged in such a way that it is situated above the sediment in the case of a standstill. The draft tube is slit in its lower region to allow easy purging.

DE 34 42 294 A1 describes a device for homogenization and suspension of solid matter turbidities in a basin. In the device a pneumatic and/or hydraulic starting-up aid is provided which facilitates starting up the stirring blades in the case of sedimented solid matters. The starting-up aid consists of pumps and nozzles. It is described how, by means of the pumps and the nozzles, by suctioning-in liquid from the upper region of a turbidity and pressing this liquid, by corresponding pipelines and pumps through the nozzles, into the lower region of the basin respectively of the container, the sediment can be disaggregated and the stirring blades are actuated only after sufficient disaggregation of the sediment.

SUMMARY OF THE INVENTION

On the basis of the prior art described above, it is the objective of the invention to provide a constructively simple and universally applicable system for starting up stirring machines in a sediment.

The system for starting up stirring machines in a sediment in a controlled manner comprises the following: a container for receiving materials to be processed; a stirring device with stirring blades for stirring the materials to be processed in the container; a purging device; and a device for operating stirring machines. In particular, the purging device is arranged and provided such that it conveys to a deposited sediment a medium for purging the sediment. The purging device is implemented in differing ways according to respective requirements. In particular, a controller is also provided, which initiates a controlled re-start of stirring machines after the purging.

Advantageous further developments of the present invention are set forth in the sub-claims.

Preferentially the medium for purging is a liquid. The purging device comprises in particular a pump and supply lines, through which the pump pumps the medium for purging.

The supply lines are in particular implemented in such a way that they convey the medium for purging below or to the stirring blades.

It is possible that liquid from the clear surface is used as a medium for purging, which liquid is drawn by the pump and fed to the supply lines.

The supply lines comprise, in particular, channels and outlets, which are part of the stirring blades.

In the system according to the present invention there sits preferably, on the shaft end and below the stirring element to be purged, a tubular stirrer which is connected to the supply lines and the purge tubes of which are oriented outward substantially parallel and aligned with the stirring blades.

The supply lines can also comprise purging lances which are situated in such a defined position with respect to the stirring blades that the medium for purging gets into the close surroundings of the stirring blades.

Herein the stirring machine preferably stops at a defined angle position with respect to the purging lances.

There is furthermore a shaft catch ring provided, which supports the shaft that carries the stirring blades, to the purpose of avoiding the shaft mechanically bending away at start-up, a maximum motor torque being required at start-up. The shaft catch ring is preferably connected, together with the purging lances, to a shared mechanically robust structure.

In the system there is moreover preferentially the controller provided with a device for measuring a sedimentation level, i.e. a deposited quantity of solid matter, or a level of the clear surface. Herein the device for measuring in particular measures a density or a pressure difference. The device for measuring may also be implemented such that it determines by calculation a deposited quantity of solid matter from material values of the suspension.

In the system according to the present invention, the device for operating stirring machines preferably sets stirring machines into operation in dependence of the determined sedimentation level.

The drive motor of the stirring machine is, in particular, operable in a frequency-controlled manner, and the stirring machine is preferentially started up over a ramp in a time-controlled manner.

The system may comprise a plurality of stirring machines, an emergency power unit being provided which intermittingly operates at least one of the stirring machines.

The pump is preferably a circulation pump which turns the medium for purging over within the container while keeping up the current pressure. The circulation pump is in particular a pump which is, in normal operation, used for conveying suspension.

The pump of the purging device is preferentially set into operation shortly after a failure of stirring machines.

Preferably an emergency power unit, which supplies the pump of the purging device with power, is provided in the system.

Preferentially there is also an interim container provided, which is arranged above a sedimentation level and, if required, is filled with the medium for purging, which is made available for short-term purging, by means of the pump.

The device for operating stirring machines is in particular set into operation in a time-delayed manner, after a time period pre-set for starting up the purging device has passed.

Further the controller is preferentially provided with devices for measuring a pressure and/or a volume flow in the supply lines, to the purpose of supplying results regarding the purging. A stirring machine is preferably re-set into operation according to the results regarding the purging, which have been obtained by the devices for measuring a pressure and/or a volume flow in the supply lines.

In the system according to the invention for starting up stirring machines in a sediment in a controlled manner, a method is carried out by means of a control, which method comprises the following steps in series: after stating a failure of a stirring machine with a stirring machine motor accompanied by sedimentation of materials to be processed which have been received in the container, the lances in supply lines are sporadically purged with the medium for purging; the sediment is fluidized via pressurized air or by the medium for purging; while keeping up the fluidization, the stirring machine is started up in reverse operation; the fluidization is stopped and the reverse operation is continued; the operation of the stirring machine is shortly stopped and the stirring machine motor is re-switched to the standard rotational direction; and then the stirring machine is operated in normal operation. Operating the stirring machine in normal operation is herein carried out, for a certain time period, while monitoring the operation via the control.

The system according to the invention for starting up stirring machines in a sediment is in particular designed in a constructively simple and universally applicable manner. By means of the control, stirring machines are re-set into operation in a controlled manner.

BRIEF DESCRIPTION OF THE DRAWING

The indicated and further features and details of the invention will be clarified to an expert having normal skill in the field from the following detailed description and from the drawings attached, which show features of the present invention in an exemplary embodiment, and wherein.

DETAILED DESCRIPTION OF PREFERRED EMBODIMENTS

Figure 1:
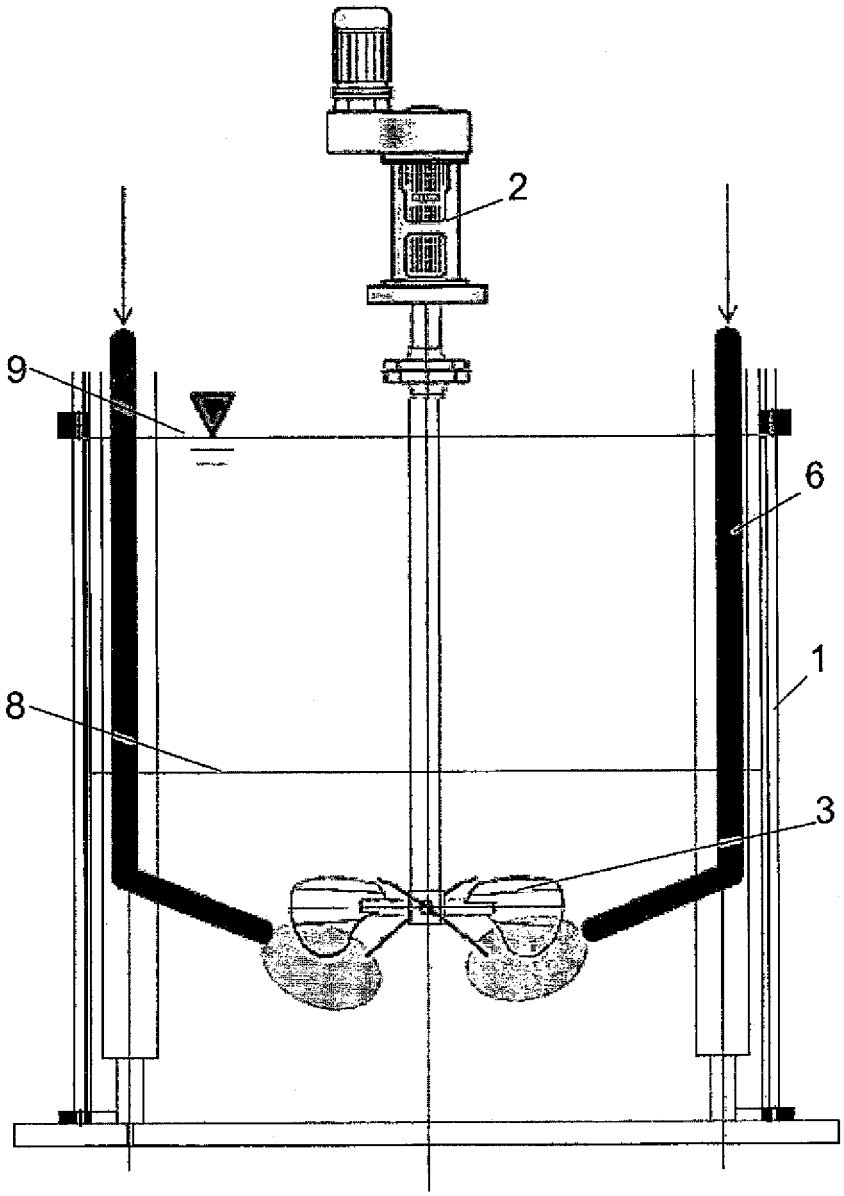
FIG. 1 shows a first exemplary embodiment of a system according to the invention for starting up stirring machines in a sediment in a controlled manner.
Figure 4:
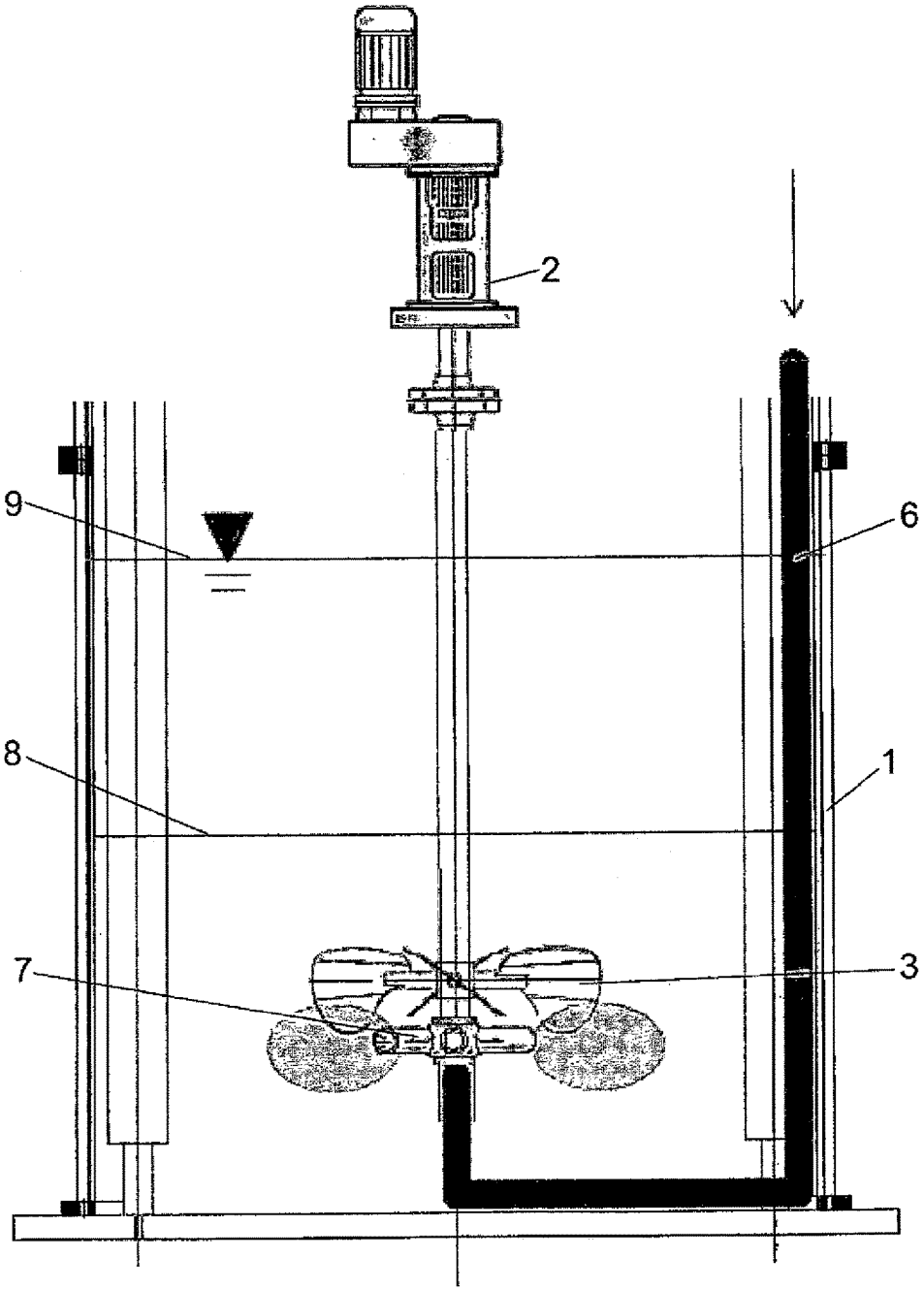
FIG. 4 shows a second exemplary embodiment of a system according to the invention for starting up stirring machines in a sediment in a controlled manner.
Figure 5:
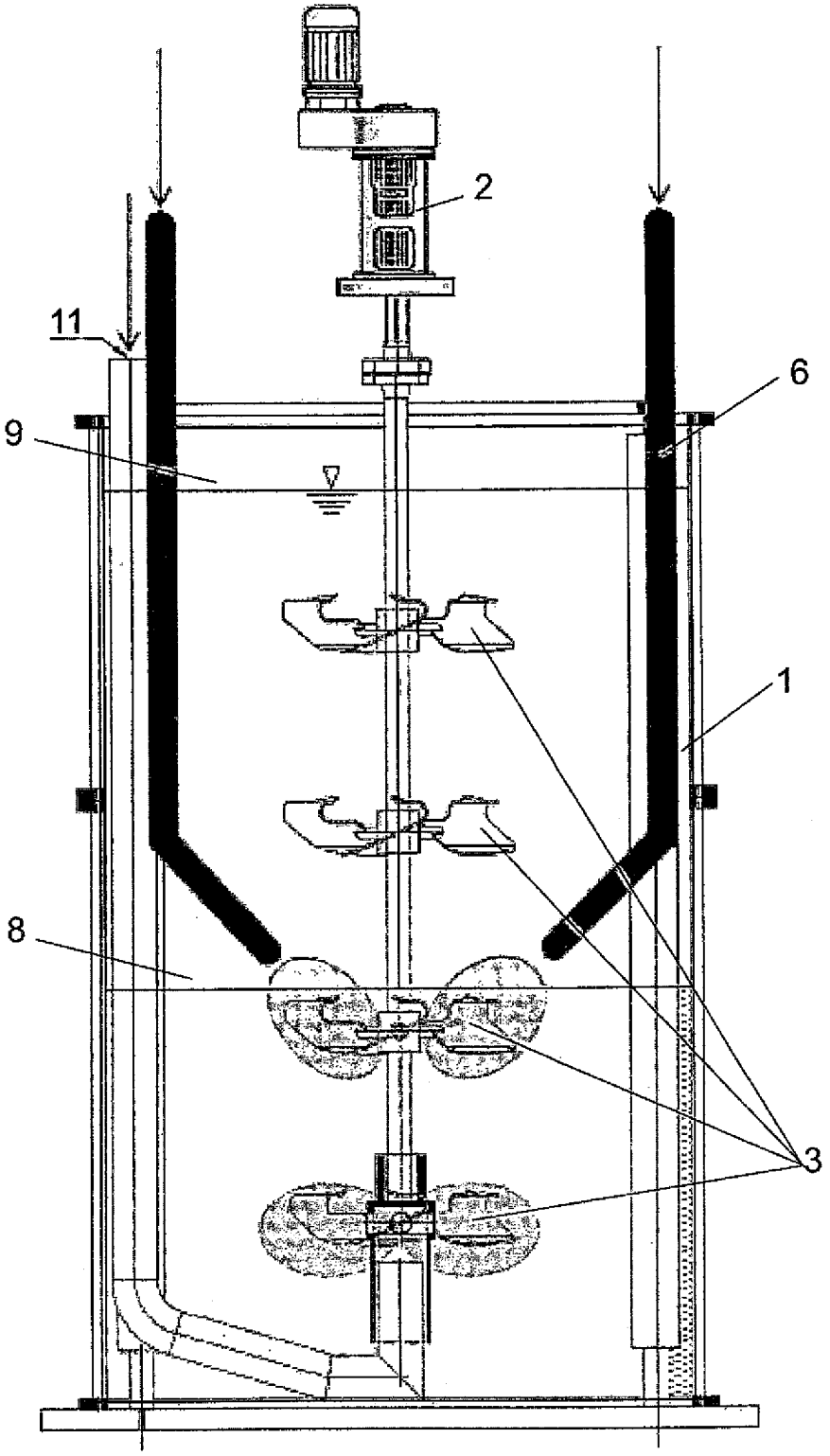
FIG. 5 shows a third exemplary embodiment of a system according to the invention for starting up stirring machines in a sediment in a controlled manner.

FIGS. 1, 4 and 5 each show an exemplary embodiment of a system according to the invention for starting up stirring machines in a sediment in a controlled manner. The system is shown to respectively comprise a container 1 for receiving materials to be processed, a stirring device with stirring blades 3 for stirring the materials to be processed in the container 1, a purging device and a device 2 for operating stirring machines. The purging device is, according to the invention, arranged and provided such that it conveys to a deposited sediment a medium for purging the sediment. The purging device in particular comprises a pump 4 (not shown in FIGS. 1, 4 and 5) and at least one supply line 6 through which the pump 4 pumps the medium for purging. The purging device is implemented in differing ways according to respective requirements and will be explained in detail referring to the figures.

In all Figures a sedimentation level is designated with 8 and a clear surface with 9.

The medium for purging is preferably a liquid. It is possible that liquid from the clear surface 9 is used as a medium for purging, which liquid is drawn by the pump 4 and fed to the at least one supply line 6. When using the liquid above the sediment, i.e. from the clear surface 9, continuous purging is possible without the container 1 being overfilled.

In the system according to the invention furthermore a device for measuring a sedimentation level 8, i.e. a deposited quantity of solid matter or a level of the clear surface 9, is provided. Herein the device for measuring in particular measures a density or a pressure difference. The device for measuring can also be designed such that it determines by calculation a deposited quantity of solid matter from material values of the suspension.

In the system of the present invention the device 2 for operating stirring machines sets stirring machines into operation preferentially in dependence of the determined sedimentation level 9.

A drive motor of the stirring machine as a device 2 for operating stirring machines is in particular operable in a frequency-controlled manner, and the stirring machine is preferably started up over a ramp in a time-controlled manner.

The system may comprise a plurality of stirring machines, an emergency power unit being provided which intermittently operates at least one of the stirring machines.

The pump 4 of the purging device is preferably a circulation pump which turns the medium for purging over within the container 1 while keeping up the current pressure. In particular, a pump which is, in normal operation, used for conveying suspension can be used as the circulation pump. The pump 4 of the purging device is preferentially set into operation shortly after a failure of stirring machines. It is in particular advantageous that, in the case of a container 1 being under pressure, the circulation pump does not have to build up the interior pressure but merely turns over the medium within the pressure space. In addition, the pump 4 starting up on failure of the stirring machine is also advantageous. The time period until the pump starts running should be maximally set such that the purging openings are not yet covered in sediment if they are situated below the sediment.

Preferably there is also an emergency power unit, which supplies the pump 4 of the purging device with power, provided in the system. In the case of a power breakdown, an emergency power unit is sufficient for the pump 4, the apparent power of which can be 2 to 10 times smaller than the power of the stirring machine motor 2. Due to the fact that only the pump 4 of the purging device is to be supplied with power, thus a power demand in the case of an operation failure is reduced. However, in big and very big containers it can be a disadvantage to design the pump 4 and the emergency power unit for short-term purging of the stirring blades 3.

Furthermore, in the system according to the present invention preferably an interim container 5 is provided, which is arranged above a sedimentation level 8 and, if required, is filled with the medium for purging by means of the pump 4, and from which the medium for purging is then conveyed to the sediment successively or "abruptly".

The device 2 for operating stirring machines, i.e. the drive motor, is in particular set into operation in a time-delayed manner, after a pre-set time period has passed after starting up the purging device.

Further preferentially, devices for measuring a pressure and/or a volume flow in the supply lines 6 are provided, to the purpose of supplying results regarding the purging. A stirring machine is preferably re-set into operation in accordance with the results regarding the purging obtained by the controller 10 shown in FIG. 3 via devices for measuring a pressure p and/or a volume flow in the at least one supply line 6. Thus a possibility of monitoring is given, and it is moreover possible to start operation of the stirring machine only if there is a sufficient purging effect.

In particular if there is a plurality of containers (cascades) present, a big pump and, if applicable, a big interim container as well, can be expedient. It is sufficient to define the power output such that the purging quantity and the purging pressure are sufficient for starting up the stirring machine. As soon as the stirring machine is running, the next stirring machine can be (re-)started and so on, until all stirring machines are in operation again.

As is shown in the Figures, the at least one supply line 6 is in particular implemented in such a way that it conveys the medium for purging below or to the stirring blades 3. The at least one supply line 6 may comprise purging lances which are situated in such a defined position with respect to the stirring blades 3 that the medium for purging gets into the close surroundings of the stirring blades 3. Herein the stirring machine preferably stops at a defined angle position with respect to the purging lances.

In FIG. 1 two supply lines 6 are shown embodied as purging lances into which the medium for purging is introduced, by means of the pump of the purging device, in a direction of the arrows depicted. The medium for purging is then pumped through the purging lances, which firstly extend at the interior edge of the container and then are bent in a direction towards the stirring blades 3. At the stirring blades 3, the medium for purging then leaves the purging lances, and there serves to purge the sediment, thus allowing starting up of the stirring machine in the sediment.

Figure 2:
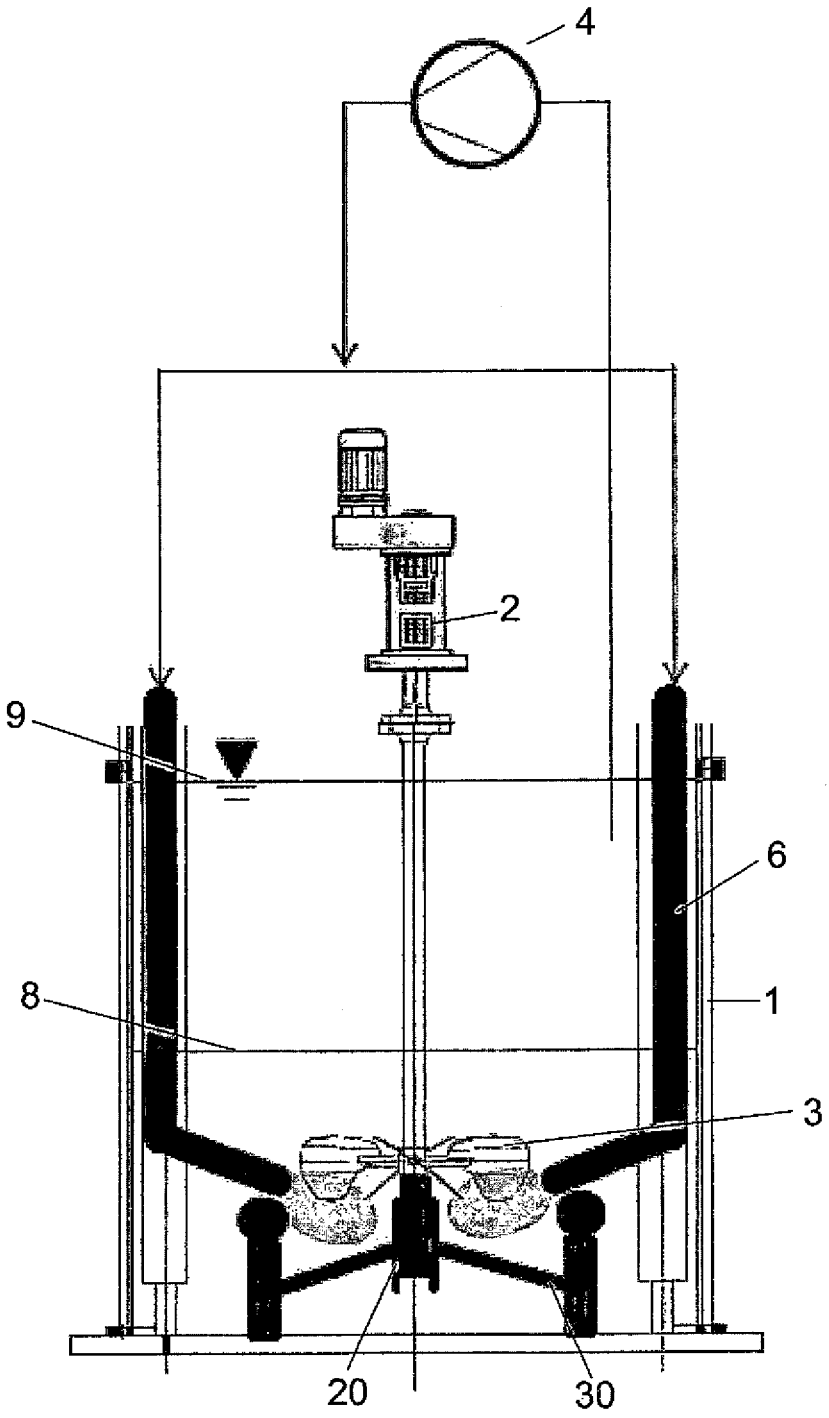
FIG. 2 shows a detailed view of the first embodiment shown in FIG. 1.

In FIG. 2 the exemplary embodiment shown in FIG. 1 is depicted in more detail. In addition to the container 1, the device 2 for operating the stirring machine, the stirring blades 3 and the supply lines 6 of the purging device, a pump 4 is shown, which takes liquid from the clear liquid surface 9 and then conveys it to the supply lines 6.

In FIG. 2 also a shaft catch ring 20 is shown, which supports the shaft that carries the stirring blades 3, to the purpose of avoiding the shaft mechanically bending away at start-up, a maximum motor torque being required at start-up. The shaft catch ring 20 is preferentially connected, together with the purging lances 6, to a shared mechanically robust structure 30.

Figure 3:
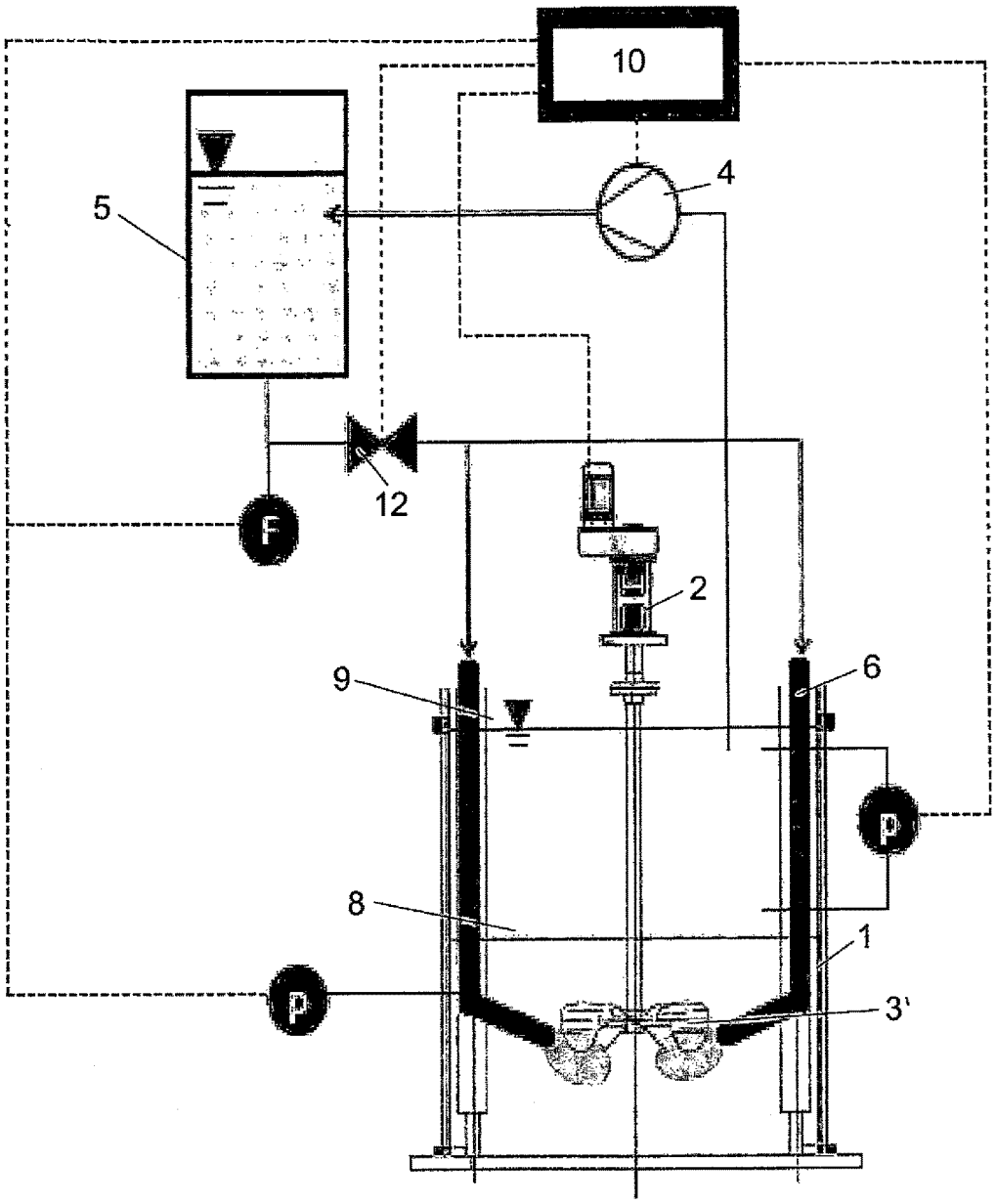
FIG. 3 shows another detailed view of the first embodiment shown in FIG. 1.

FIG. 3 shows another more detailed illustration of the exemplary embodiment depicted in FIG. 1. In addition to the pump already depicted in FIG. 2, an interim container 5 is shown in which liquid pumped from the clear liquid surface 9 can be stored until it is required. If the liquid is required, is determined by a controller 10 including a measuring equipment designated p for measuring a pressure and/or a volume flow in the at least one supply line 6 and for measuring the filling level F of the interim container 5. A shut-off valve 12 for regulating a flow of the liquid from the interim container 5 to the supply lines, which shut-off valve 12 is actuated by the controller 10, is also shown.

From FIGS. 2 and 3 it can be perceived that the system for starting up stirring machines in the sediment can be designed in a flexible manner, according to respective requirements. It is further pointed out that the pump 4, the interim container 5 and the controller 10 (including measuring equipment etc.) are not only or cannot only be provided in the exemplary embodiment of the present invention shown in FIG. 1, but that the exemplary embodiments of the present invention shown in FIGS. 4 and 5 are also or may also be provided with the pump 4, the interim container 5 and the controller 10 (including measuring equipment etc.).

In FIG. 4 a supply line 6 is shown in the form of purging lances, into which the medium for purging is introduced, by the pump 4 of the purging device, in a direction of the arrow shown. The medium for purging is then pumped through the purging lance, which firstly extends at the interior edge of the container 1, is bent, at the bottom of the container, in a direction towards the center of the container 1 and is then bent, in the center and at the bottom of the container 1, in a direction upwards and extends up to shortly below the stirring blades 3. At this point, on the shaft end and below the stirring element to be purged, there sits a tubular stirrer 7, which is connected to the supply line 6 and the purging tubes of which are orientated outwards in a manner substantially parallel and aligned with the stirring blades 3. As an alternative, the supply line 6 may also be extended up to the stirring blades 3, where the medium for purging can be discharged to channels and outlets which are part of the stirring blades 3. In this case no tubular stirrer 7 is required, however the stirring blades 3 are to be equipped with channels and outlets.

In FIG. 5 a system comprising a plurality of stirring elements with stirring blades 3 is shown. Two of the four stirring elements depicted are shown in the sediment below the sedimentation level 8, and the other two stirring elements are shown above the sediment but underneath the clear liquid surface 9. In the case of the upper stirring element of the two stirring elements shown in the sediment, a medium for purging is introduced in the same way as already described referring to FIG. 1. However, differently from FIG. 1, the medium for purging is fed by the two purging lances 6 shortly above the stirring blades 3. Furthermore, in FIG. 5 a pipe 11 is shown at the lefthand side of the interior wall of the container 1, to which a medium for purging is fed in a direction of the arrow depicted. The medium for purging can be fed from the interim container shown in FIG. 3, which is situated above the stirring machine. The pipe 11 extends at the interior wall of the container 1 in a direction downwards to the bottom of the container 1, is bent shortly above the bottom in a direction towards the center of the container 1 and is bent, in the center of the container, such that it extends upwards to the center of the stirring element. At the stirring element the medium for purging is discharged into channels which are located in the stirring blades 3. From there the medium for purging is discharged into the sediment via outlets at the stirring blades 3. According to the system shown in FIG. 5, a medium for purging is fed to the sediment at two points, at which points there are stirring elements in the sediment. Thus both stirring elements which are in the sediment can be purged.

In particular, additional purging lances may be fitted in to function as supply lines 6. An already existing gassing system may also be used, which is supplied with the medium for purging and shortly serves as a purging device.

It is moreover advantageous to mechanically brake and position the stirring element in such a way that it stops in a defined position, where the purging lances 6 are also arranged above the stirring blades 3 and the flow of the medium for purging thus directly hits on the stirring blades 3.

By means of the controller a method is carried out wherein, after stating a failure of a stirring machine having a stirring machine motor accompanied by sedimentation of materials to be processed that have been received in the container, the lances in supply lines are sporadically purged by the medium for purging. The sediment is fluidized by purging via pressurized air or via the medium for purging. While keeping up fluidization; the stirring machine is started up in the reverse operation. The fluidization is stopped and the reverse operation is continued. The operation of the stirring machine is shortly stopped and the stirring machine motor is re-switched into the standard rotational direction. Eventually the stirring machine is operated in the normal operation. Operating the stirring machine in the normal operation is carried out, for a certain time period, while monitoring the operation via the controller and its devices for measuring.

The universally applicable system according to the present invention allows starting up a stirring machine in a sediment in a controlled manner, without a major effort being required. Herein it does not matter if the stirring machine is situated in a centric or in an eccentric manner or in a draft tube, respectively if the stirring machine shaft is mechanically guided or supported, nor the number of stirring element stages. According to the present invention, the stirring blades are purged and the sediment is locally disaggregated.

What is claimed is:

1. A system for starting up a stirring machine in a sediment in a controlled manner, comprising:

a container for receiving a material to be processed, the container includes a top side and a bottom;

a stirring device having stirring blades for stirring the material to be processed in the container;

a purging device configured to convey to a deposited sediment of the material a medium for purging the deposited sediment, the purging device comprises a pump and at least one supply line through which the pump pumps the medium for purging;

a device for operating the stirring machine which comprises a drive motor, the device for operating the stirring machine further comprises a shaft that supports the stirring blades, a shaft catch ring that supports the shaft, and support elements that attach to the shaft catch ring and multiple points on the bottom of the container, the shaft catch ring and the support elements are arranged below the stirring blades when viewed from the top side of the container towards the bottom of the container; and a controller configured to initiate a controlled re-start of the stirring machine after purging has been effected, the controller is provided with a measurement device that measures a sedimentation level in the container.

2. The system of claim 1, wherein the medium is a liquid.

3. The system of claim 1, wherein the at least one supply line is configured to convey the medium below or to the stirring blades.

4. The system of claim 1, wherein the medium is a liquid from a clear surface above the deposited sediment within the container and drawn by the pump and fed to the at least one supply line.

5. The system of claim 1, wherein the at least one supply line comprises channels and outlets which are part of the stirring blades.

6. The system of claim 1, wherein the device for operating the stirring machine has a shaft for support of the stirring blades, and further comprising a tubular stirrer mounted on an end of the shaft below the stirring device to be purged and connected to at least one supply line, said tubular stirrer having purge tubes which are orientated outward in substantially parallel and aligned relationship to the stirring blades.

7. The system of claim 1, wherein the at least one supply line comprises purging laces situated in a defined position with respect to the stirring blades such that the medium is in close proximity of the stirring blades.

8. The system of claim 7, wherein the stirring machine stops at a defined angle position with respect to the purging lances.

9. The system of claim 1, wherein the at least one supply line comprises purging lances situated in a defined position with respect to the stirring blades, the shaft catch ring being connected together with the purging lances to a shared structure.

10. The system of claim 1, wherein the measurement device is configured to measure a density or a pressure difference.

11. The system of claim 1, wherein the measurement device is configured to determine by calculation a deposited quantity of deposited sediment from material properties of a suspension.

12. The system of claim 1, wherein the device for operating the stirring machine is configured to operate the stirring machine in dependence of the determined sedimentation level.

13. The system of claim 1, wherein the device for operating the stirring machine is a drive motor configured to run in a frequency-controlled manner, and wherein the stirring machine is started up over a ramp in a time-controlled manner.

14. The system of claim 1, wherein the pump is a circulation pump to circulate the medium within the container while maintaining a constant pressure.

15. The system of claim 14, wherein the circulation pump is a pump configured to convey a suspension.

16. The system of claim 1, wherein the pump of the purging device is caused to operate within a short time after the stirring machine fails to operate.

17. The system of claim 1, further comprising an emergency power unit configured to supply power to the pump of the purging device.

18. The system of claim 1, further comprising an interim container arranged above a sedimentation level of the material and configured to receive the medium from the pump for executing a short-term purging.

19. The system of claim 1, wherein the device for operating the stirring machine is configured for operation in a time-delayed manner after elapse of predefined time period for starting up the purging device.

20. The system of claim 1, wherein the controller includes a measurement device for measuring a pressure and/or a volume flow in the at least one supply line to provide a result regarding a purging operation.

21. The system of claim 19, wherein the measurement device is configured to restart the stirring machine in response to the provided result.

22. A system for starting up a stirring machine in a sediment in a controlled manner, comprising:

a container for receiving a material to be processed, the container includes a top side and a bottom;

a stirring device having stirring blades for stirring the material to be processed in the container;

a purging device configured to convey to a deposited sediment a medium for purging the sediment, wherein the purging device comprises a pump and at least one supply line through which the pump pumps the medium for purging, wherein the at least one supply line comprises purging lances which firstly extend at the interior edge of the container and then are bent in a direction towards the stirring blades;

a device for operating the stirring machine which comprises a drive motor, the device for operating the stirring machine further comprises a shaft that supports the stirring blades, a shaft catch ring that supports the shaft, and support elements that attach to the shaft catch ring and multiple points on the bottom of the container, the shaft catch ring and the support elements are arranged below the stirring blades when viewed from the top side of the container towards the bottom of the container; and a controller configured to initiate a controlled re-start of the stirring machine after purging has been effected, wherein the controller is provided with a device for measuring a sedimentation level.

23. The system of claim 22, wherein the stirring device, the device of operating the stirring blades and the purging lances are arranged inside the container at least essentially in alignment when viewed from a top side of the container towards a bottom of the container.

* * * * *